US006184501B1

(12) United States Patent
Zapf

(10) Patent No.: US 6,184,501 B1
(45) Date of Patent: Feb. 6, 2001

(54) OBJECT DETECTION SYSTEM

(75) Inventor: Martin K. Zapf, Creussen (DE)

(73) Assignee: Cherry GmbH, Auberbach/Opf. (DE)

( * ) Notice: Under 35 U.S.C. 154(b), the term of this patent shall be extended for 0 days.

(21) Appl. No.: 09/405,296

(22) Filed: Sep. 23, 1999

(51) Int. Cl.[7] ..... H05B 3/68; H05B 1/02
(52) U.S. Cl. ..... 219/447.1; 219/518
(58) Field of Search ..... 219/445.1, 446.1, 219/447.1, 448.11, 448.12, 518, 497, 541, 543

(56) References Cited

U.S. PATENT DOCUMENTS

| | | | | |
|---|---|---|---|---|
| 3,789,190 | * | 1/1974 | Orosy et al. | 219/497 |
| 5,136,277 | * | 8/1992 | Civanelli et al. | 219/447.1 |
| 5,424,512 | * | 6/1995 | Turetta et al. | 219/447.1 |
| 5,491,423 | * | 2/1996 | Turetta | 219/447.1 |
| 5,893,996 | * | 4/1999 | Gross et al. | 219/447.1 |
| 5,900,174 | * | 5/1999 | Scott | 219/447.1 |

* cited by examiner

*Primary Examiner*—Sang Paik
(74) *Attorney, Agent, or Firm*—Sam Silverberg

(57) ABSTRACT

A system for detecting the presence of a cooking vessel positioned over a heating element of a cooking hob comprises a drive loop for generating a time varying magnetic field upon the application of an alternating current thereto a sensor loop proximal to said drive loop wherein in the absence of a cooking vessel said time varying magnetic field generates a sensor signal in said sensor loop and said sensor signal is reduced in magnitude when a metallic cooking vessel is placed vicinal to said drive loop; a current supply for supplying said alternating current to said drive loop; and a controller connected to said current supply and said sensor loop for monitoring said sensor signal to determine the presence of said cooking vessel and for controlling said heating element in response thereto, said drive loop and said sensor loop being electrically connected to each other. Drive loops and sensor loops of more than one detection element may also be connected together by a common connection. A temperature sensor may be included in the system.

10 Claims, 6 Drawing Sheets

OBJECT DETECTION SYSTEM

BACKGROUND OF THE INVENTION

The invention relates to an object detection system and in particular, but not exclusively, to a system for detecting the presence of a metallic cooking utensil on a non-metallic cooking surface. Such systems provide enhanced safety for cooking surfaces since heating is provided only when a cooking pot is in place on the cooking surface.

Cooking platforms capable of pot detection are well known in the art, and operate according to a variety of principles. Capacitive systems are known from, for example, EP-A-0 429 120 (U.S. Pat. No. 5,136,277), DE-A-42 24 93934, DE-A-28 31 858, DE-A-37 33 108 and DE-A-38 43 460. Optical detection systems are known from DE-A-35 33 997 and DE-A-31 17 205 and acoustic systems are known from DE-A-36 19 762. A system in which reflected radiation is detected is known from DE-A-197 29 418. Other systems include active components in the cooking pots which interact with transmitters and receivers on the cooker.

A further type of known pot detection system is one where the inductive properties of metallic cooking utensils are used to modify a magnetic field generated in the vicinity of a cooking element and hence enable the detection of the pot. A first group of inductive based systems detect a change in resonant frequency of a circuit attached to a sensor coil placed in the vicinity of a cooking element. Examples of such systems are disclosed in EP-A-0 469 189 and EP-A-442 275 (U.S. Pat. No. 5,296,684).

A second group of inductive detection systems comprise a magnetic field source in the region of a cooking element and a sensor inductively coupled thereto. Placing a metallic object in the vicinity of the source influences the inductive coupling to the sensor in a manner which can be detected. An example of such a system is described in DE-A-37 11 589. In the system described therein an a.c.-operated magnetic field generator, placed at a distance below a cooking area, generates a magnetic field directed towards the cooking area. A loop lying in the external boundary area of the a.c. field is used to monitor the influence on the a.c. field of a container placed on the cooker and thereby control the switching on and off of the heating element.

A further inductive system of the second type is described in DE-A-197 00 753 a double loop arrangement is employed in which a driver loop is attached or deposited on the underside of a glass-ceramic cooking surface. This driver loop is used to generate an RF magnetic field. One or more sensor loops are arranged within or around the driver loop and these are used to generate a voltage signal which is dependent on the magnitude of the time varying magnetic field therein. If a metallic or metal containing cooking pot is placed over the driver loop, eddy currents are induced therein which have the effect of reducing the net magnetic flux in the sensor loops. Placing a pot on the driver loop therefore has the effect of reducing the voltage generated by the sensor loop. Information regarding the presence of a cooking pot can therefore be derived from this induction signal.

In the system described in DE-A-197 00 753 transformers are incorporated between a current source and the drive loop and also between the sensor loops and the detecting electronics. It is presumed by the present inventor that such transformers are provided in order to provide isolation from electrostatic charges. Since a conventional cooking surface comprises four or five cooking areas, the number of transformers required would add significantly to the cost of manufacture of such an arrangement. Furthermore, it would appear that a separate detection circuit is provided for each sensor loop.

SUMMARY OF THE INVENTION

It is an object of the present invention to provide an alternative object detection system. The object, and others to become apparent as the description progresses, are achieved by the provision of a system for detecting the presence of a cooking vessel positioned over a heating element of a cooking hob comprising: a first drive loop for generating a time varying magnetic field upon the application of an alternating current thereto; a first sensor loop proximal to said drive loop wherein, in the absence of a cooking vessel, said time varying magnetic field generates a sensor signal in said sensor loop and said sensor signal is reduced in magnitude when a metallic cooking vessel is placed vicinal to said drive loop; a current supply for supplying said alternating current to said drive loop; and a controller connected to said current supply and said sensor loop for monitoring said sensor signal to determine the presence of said cooking vessel and for controlling said heating element in response thereto, wherein said drive loop and said sensor loop are electrically connected to each other.

By connecting said drive loop and said sensor loop electro-static discharge risks are minimized.

In a preferred embodiment the alternating current is passed to the drive loop by connection leads connected to the drive loop wherein one of the connection leads is a common lead which is also connected to the sensor loop.

Another preferred embodiment provides that the common lead has a cross-sectional width which is greater than a cross-sectional width of the other connection lead.

The system may further comprise a second drive loop and an second sensor loop positioned around said first drive and sensor loops, and wherein the first and second drive and sensor loops are electrically connected to each other.

Another preferred embodiment provides that the input leads are connected to ends of the first and second drive loops and wherein input leads connected to the second drive loop are arranged on each side of leads connected to the first drive loop.

The system may further comprise a plurality of drive loops and sensor loops for detecting the presence of a cooking vessel placed over one of a plurality of heating elements.

In yet another embodiment of the system, the plurality of drive loops and the plurality of sensor loops are electrically connected together.

The invention further provides that the sensor signals generated by the plurality of sensor loops are multiplexed to the controller.

A further embodiment provides that at least one of the drive and sensor loops has connections thereto for monitoring the electrical resistance thereof.

The system of the invention may be used to detect the presence of a cooking vessel over a single zone heating element or a two-zone heating element. In the latter case, multiple drive and sensor loops may be provided to correspond with the multiplicity of heating areas.

Drive loops and sensor loops of detection elements corresponding to separate cooking elements may be connected together to provide enhanced electrostatic discharge protection, particularly where signals are multiplexed to a single controller.

BRIEF DESCRIPTION OF THE DRAWINGS

Embodiments of the invention will now be described, by way of example only, with reference to the accompanying drawings in which.

DETAILED DESCRIPTION OF PREFERRED EMBODIMENTS OF THE INVENTION

Figure 1:
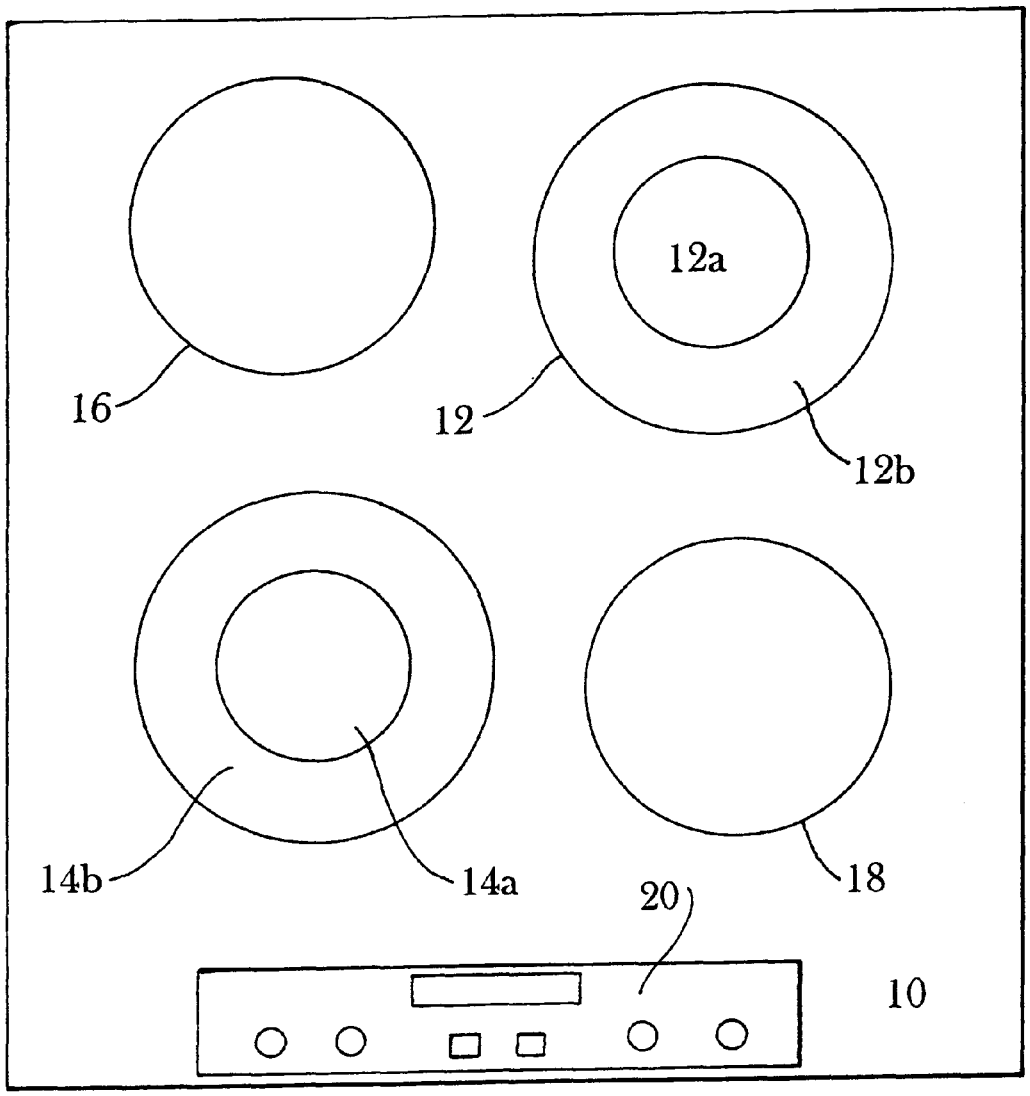
FIG. 1 is a schematic illustration of a cooking surface incorporating the present invention.

FIG. 1 shows a schematic view of a glass-ceramic cooking surface 10 having a total of four cooking regions 12, 14, 16, 18. The two cooking regions 12 and 14 each comprise two-zone heating elements having a central region 12*a* and 14*a* respectively and an outer region 12*b* and 14*b* respectively. The temperature or power supplied to the cooking elements is selected by a user using controls on a control panel 20.

Figure 2:
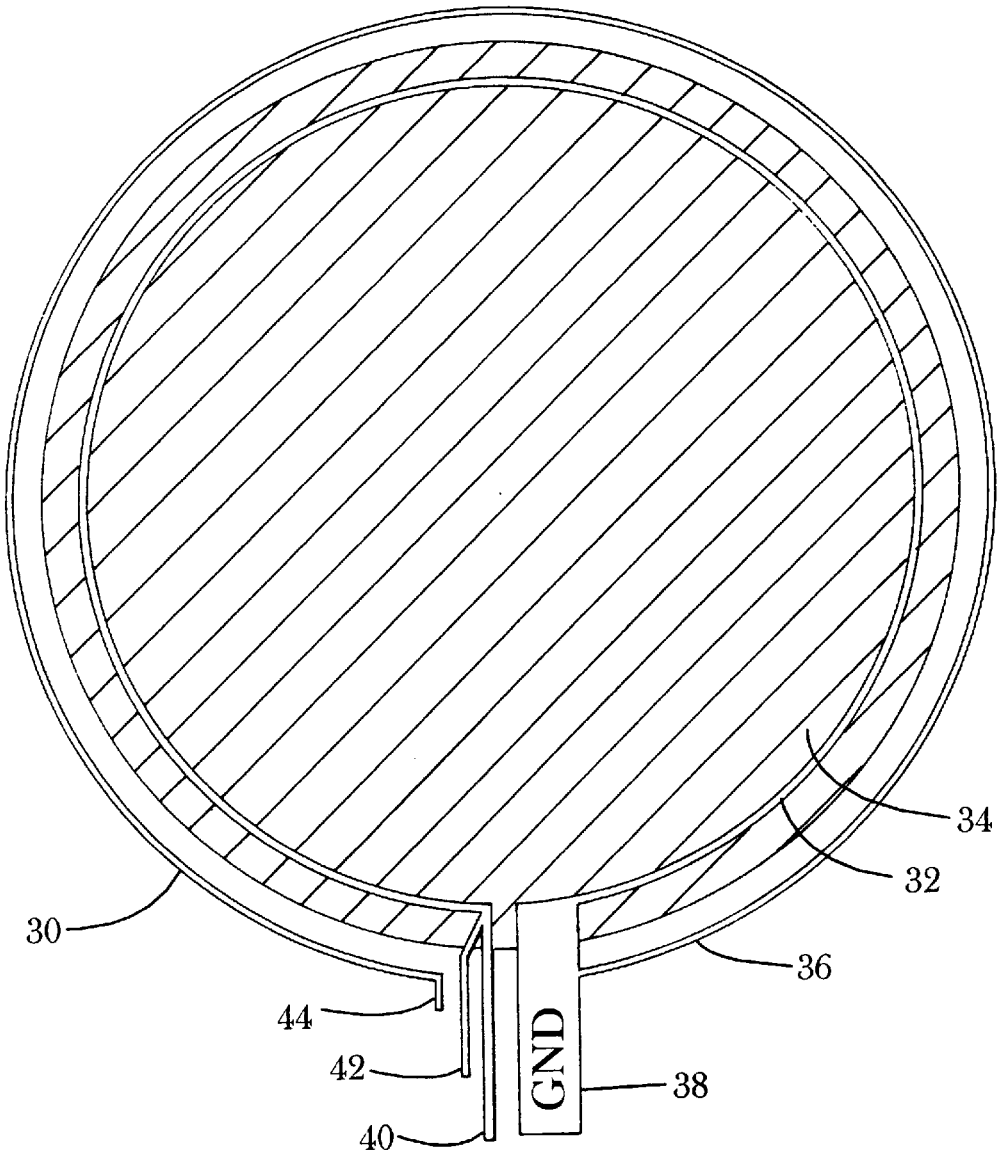
FIG. 2 illustrates a single element detection arrangement.

Referring now to FIG. 2, there is shown a detection arrangement 30 of the invention for use with a single zone cooking element of the surface 10. The arrangement 30 comprises a drive loop 32 arranged to be within a heating zone 34 and a sensor loop 36 arranged around the drive loop 32. Each of the loops 32 and 36 has a contact lead connected to it at each of its two ends. As shown in FIG. 2, at the right hand end of the loops, both the drive loop 32 and the sensor loop 36 are connected by a single, relatively broad common lead 38. The other end of the drive loop 32 is connected by an input lead 40 and a temperature sensor lead 42. The purpose of the temperature sensor lead 42 will be explained in more detail below. An output lead 44 is connected to the other end of the sensor loop 36. As indicated in FIG. 2, the leads 40 and 44 are relatively thin compared to the common lead 38.

The loops 32 and 36 together with the leads 38, 40, 42 and 44 are preferably deposited on the underside of the glass ceramic cooking surface 10 in a known manner using a screen-printing technique of a suitable conducting material which is then annealed to provide the necessary conducting properties and adhesion to the surface 10. The leads 38–44 are routed to an edge of the surface 10 where they are connected to a multi-line strip cable (not shown) and thence associated signal processing electronics (not shown).

A cooking surface has a plurality of such detection arrangements which are sequentially switched to the processing electronics in a multiplexed arrangement. Such switching arrangements are however subject to electrostatic charge build up if the components are electrically isolated when not connected through a multiplexer. In the present invention, the common lead 38 contacts each of the loops and therefore these will have a common potential. Since they sit at a common potential, the risk of electrostatic discharge between the loops is removed. If electrostatic discharge were to occur, this would be very damaging to connected electronics. As discussed above, the prior art in DE-A-197 00 753 incorporates a complicated transformer arrangement to protect against electrostatic discharge.

In operation, an a.c. electric current is supplied to the drive loop 32 via the leads 38 and 40. This current induces an alternating magnetic field in the loop 32 and outside it. As a result of this alternating magnetic field, an a.c. current is generated in the sensor loop 36, which is detected as an alternating voltage. The magnitude of the detected voltage is determined by the signal applied to the drive loop 32 and the inductive coupling between the drive loop 32 and the sensor loop 36. In the absence of a cooking pot placed over the heated zone 34 and a given drive signal, a particular output voltage will be generated. If now a metallic cooking pot is placed over the heated zone 34, eddy currents will be induced therein by the alternating magnetic field generated by the drive loop 32. These eddy currents result in a magnetic field which is opposite in sense to that generated by the drive loop 32. The net effect is that the voltage signal generated by the sensor loop 36 is reduced.

The signal processing electronics mentioned above may comprise a microcontroller having a plurality of analog signal inputs, preferably eight. These multiple inputs, including the voltage signal from the sensor loop 36 are multiplexed by the microcontroller and analyzed in a sequential manner to determine changes in voltage signal which would indicate a pot having been placed over a heated zone. If this is detected, power to the relevant heating element is switched on via a relay arrangement, provided that a user has set the controller for that heating element on the control panel 20 If the pot is subsequently removed whilst the control remains set, power is disconnected to the heating element. In certain circumstances, a user may wish to override this automatic control, with the power being maintained to the heating element despite a pot having been removed, and a control function to achieve this may be provided on the control panel 20.

The temperature sensor lead 42 is used to monitor the electrical resistance of the drive loop 32 in order to control the temperature at the cooking surface. As the temperature increases, the resistance of the drive loop 32 will increase. This resistance is measured using a four point measurement technique to minimize the effects of contact resistance and lead resistance contributing to the measured value. A d.c. current is passed around the drive loop 32 between the common lead 38 and the input lead 40. A potential drop across the drive loop 32 is measured using the temperature sensor lead 42 and a connection (not shown) to the common lead 38.

Figure 3:
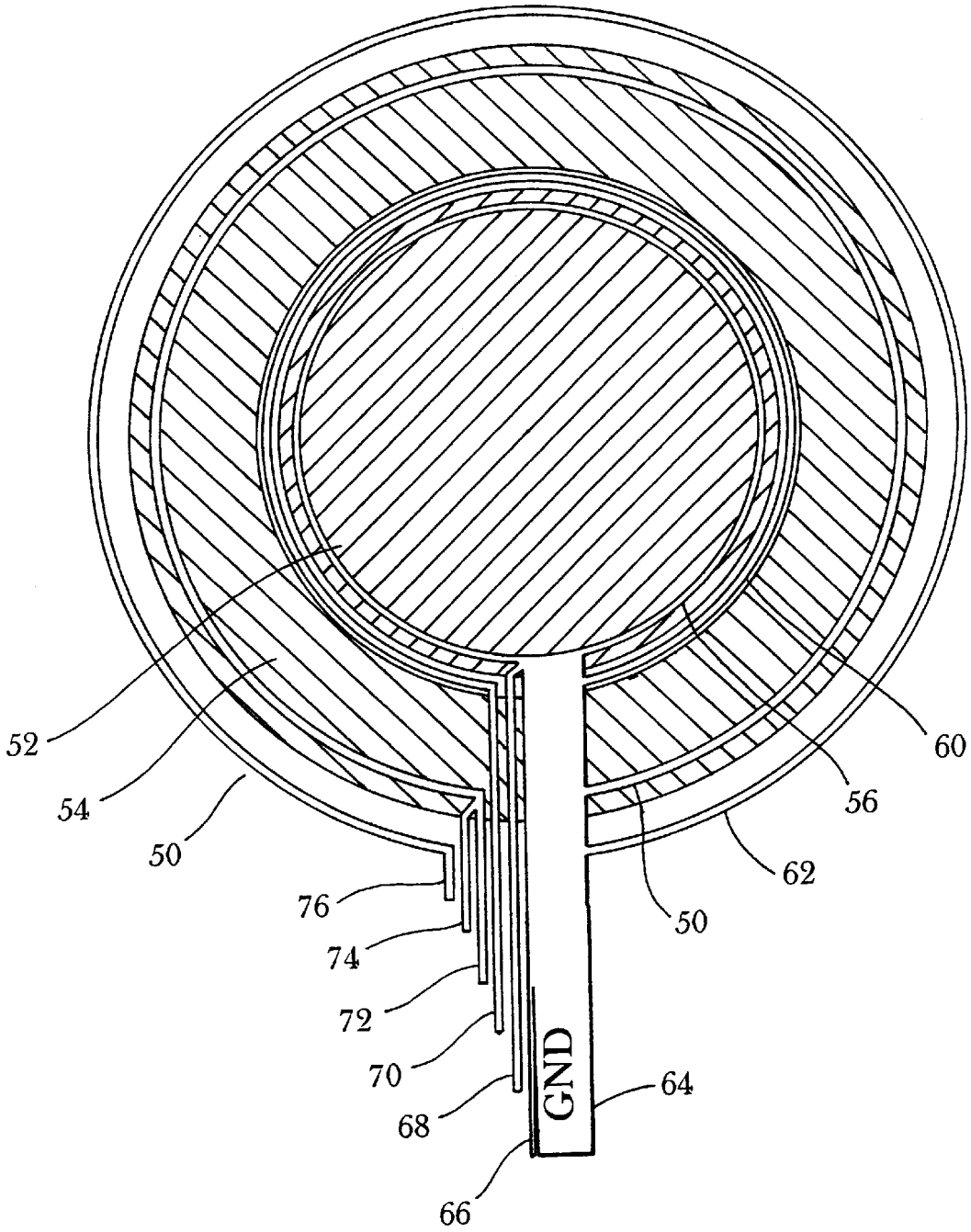
FIG. 3 illustrates a two-zone detection arrangement.

Referring now to FIG. 3, there is shown a two zone detection arrangement 50. The arrangement 50 is used in combination with a two zone heating element which produces a central heated zone 52 and an outer heated zone 54. The arrangement 50 comprises an inner drive loop 56 and an outer drive loop 58 together with an inner sensor loop 60 and an outer sensor loop 62. As in the arrangement 30, a common lead 64 contacts one end of each of the loops 56–62. The other end of the inner drive loop 56 is connected by an inner input lead 66 and an inner temperature sensor lead 68. The other end of the inner sensor loop 60 is connected by an inner output lead 70; the other end of the outer drive loop 58 is connected by an outer input lead 72 and an outer temperature sensor lead 74 and the other end of the outer sensor loop is connected by an outer output lead 76. The loops and leads of the arrangement 50 are fabricated and operated in a similar manner to those of the arrangement 30.

Figure 4:
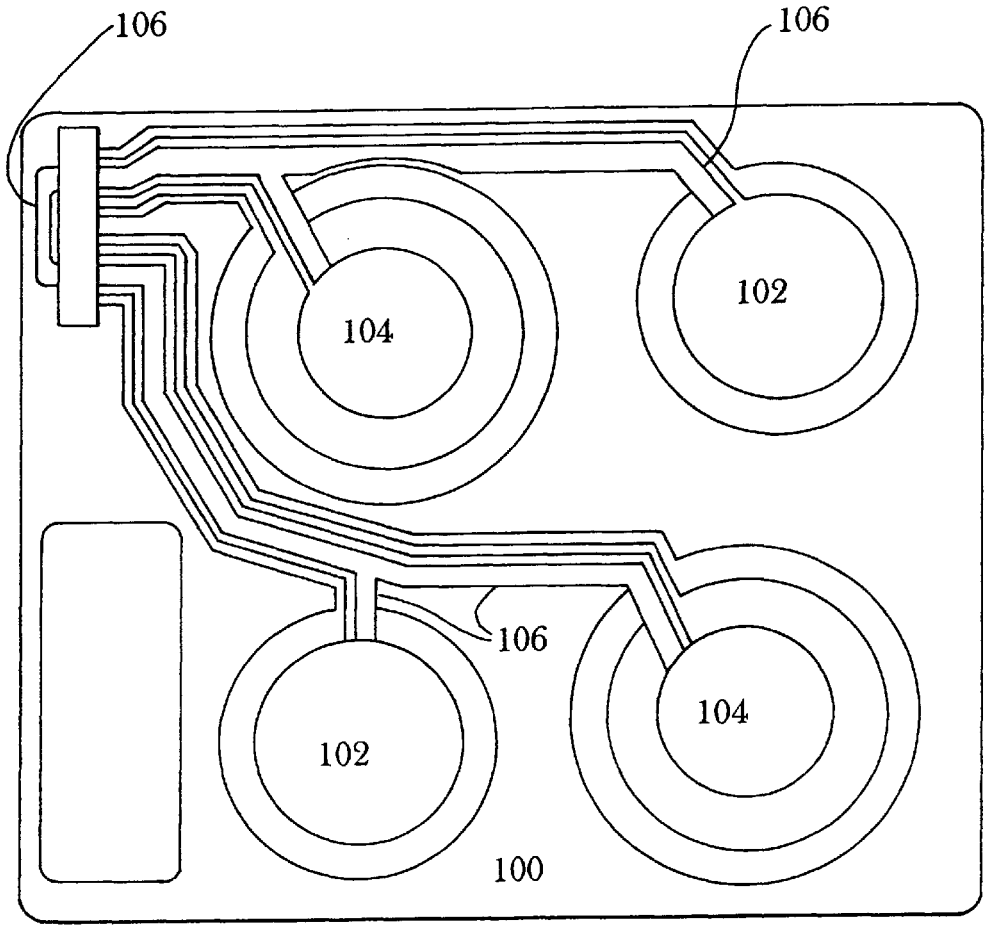
FIG. 4 illustrates a cooking surface incorporating the arrangements of FIGS. 2 and 3.

Referring now to FIG. 4, there is shown a possible arrangement for the input and output leads and temperature sensor leads for a four element cooking surface 100 having two single zone elements 102 and two two-zone cooking elements 104. FIG. 4 shows that a single common lead 106 is used to contact all of the drive loops and sensor loops on the surface 100. When designing the arrangement of leads to detection arrangements for the elements 102 and 104, there are a number of factors which need to be taken into consideration.

It is desirable that the contact leads to the loops are not subject to temperatures greater than 150° C. Since usually the temperatures inside a cooking platform are higher than 150° C., contact positions contact positions to the loops should be located in a border area of the cooking field. Additionally, long leads increase the possibility for erroneous signals, for example arising by a pot being placed on the leads rather than over a cooking element.

An isolation separation of at least 8 mm should preferably be maintained between the detection arrangements and parts of the cooking surface having a mains voltage, e.g. power contacts for the heating elements and any protection temperature limiters since at temperatures greater than approximately 250° C., the glass ceramics behave as conductors rather than insulators and therefore the detection arrangements must be considered to be touchable.

As shown in FIG. 4, the leads have to be directed over long distances on the cooking surface. A pot which is placed over the input leads will tend to cause a reduction on the generated magnetic field and therefore an interference in the desired signal. To minimize the interference, the area surrounded by the sensor loops should be as small as possible. Furthermore, to avoid shorts between the leads during manufacture, it is advisable to maintain a separation of about 1.25 mm between the leads of the detection arrangements.

The ohmic input and output lead resistances should be kept to a minimum to avoid capacitive coupling. A capacitive coupling occurs because the input and output leads lie close to one another. This capacitive coupling would lead to a reduction in the induction voltage. Furthermore, since the glass-ceramic is a dielectric, a cooking utensil placed on the cooking surface represents a potential in the detector circuit through capacitive coupling. If a person touches the utensil, a capacitive leakage to earth will occur, leading to a reduction in the magnetic field magnitude and an undesired reduction of the detected voltage. For this reason both the ohmic and inductive resistances should be minimized. There is however a conflict between increasing the lead width to reduce resistance and decreasing it to reduce the coupling area. Preferably, the leads have a resistance of 100 ohm/m with a conductor width of 1 mm, with a input lead width of 2 mm for lengths up to 300 mm and 3 mm for lengths up to 600 mm.

Figure 5:
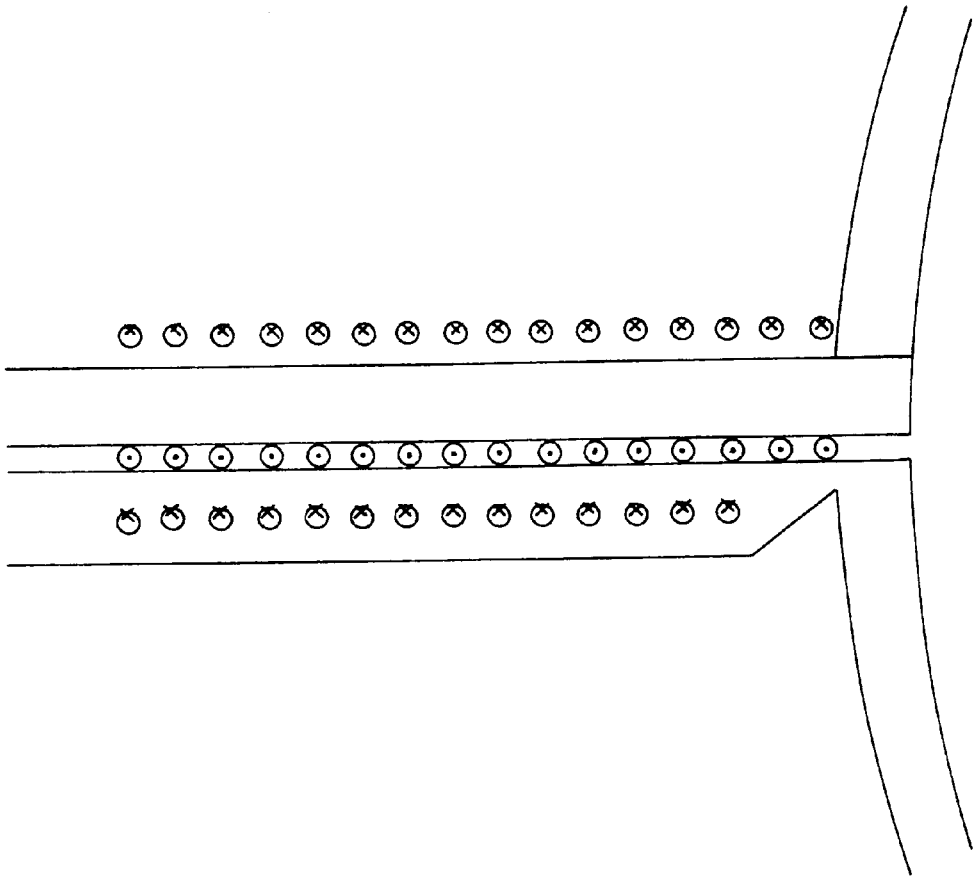
FIG. 5 illustrates a lead arrangement for the FIG. 2 arrangement.

As shown in FIG. 4, the input leads and the output leads follow the same general path. In order to minimize the suppressive effect of cooking utensils being placed on the input leads, the voltage induced in the input leads should be reduced. It is beneficial to arrange that the output lead is located as far as possible from the input lead so that as much of the magnetic field generated along the input lead is enveloped, as shown in FIG. 5. In practice, distances of 10 to 13 mm are acceptable.

Figure 6:
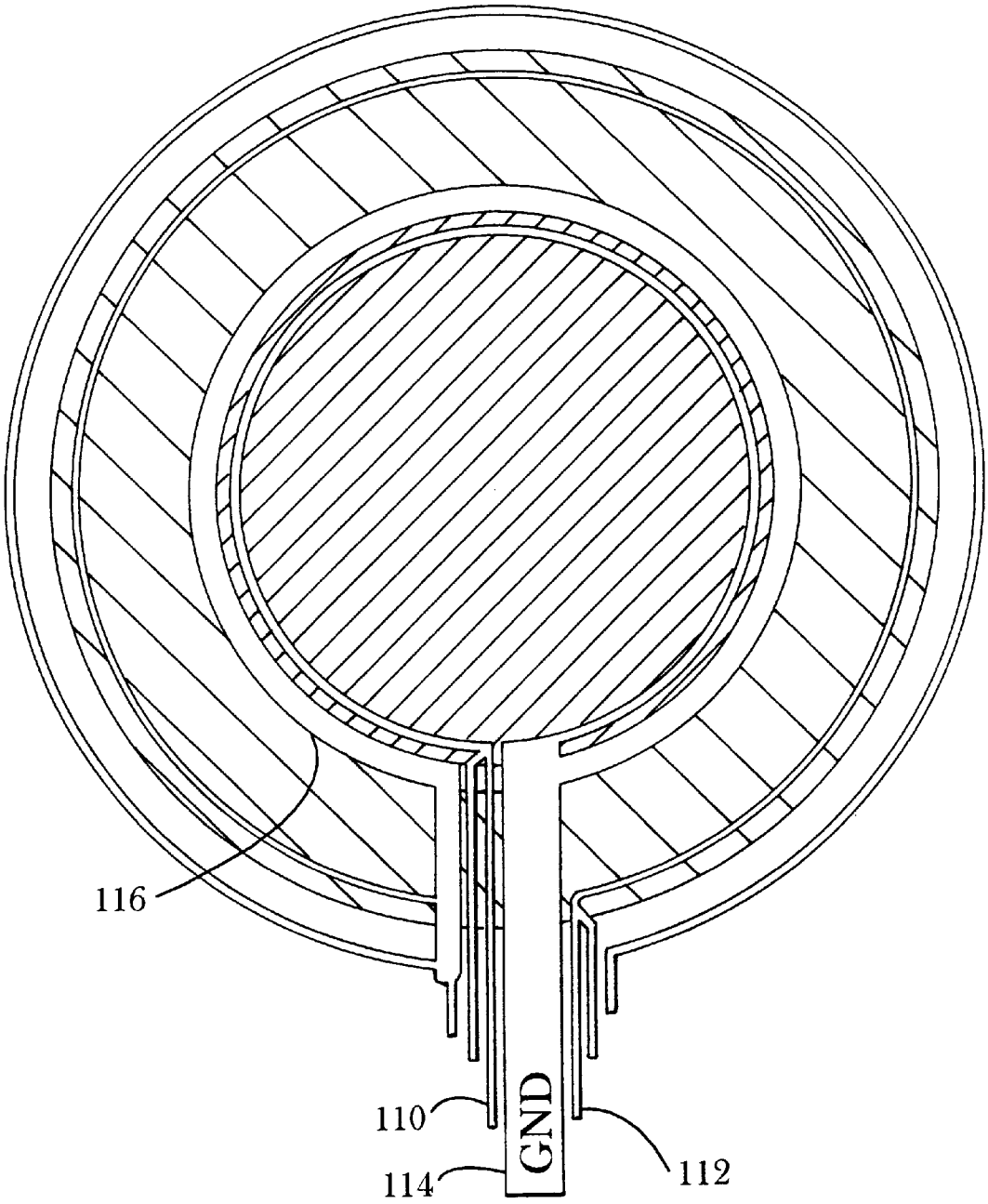
FIG. 6 shows an alternative for the FIG. 3 configuration.

For two-zone heating elements, it may not be desirable to have an input arrangement as shown in FIG. 3 where a large distance for the input leads is necessary. An alternative arrangement is shown in FIG. 6 in which input leads 110 and 112 for an inner and outer drive loop respectively are mirrored about a ground lead 114. In addition, rather than the ground lead 114 being connected to all of the loops directly, the outer loops are connected via an inner sensor loop 116 which is of greater width than that shown in FIG. 3.

Whilst the above descriptions of embodiments of the invention have been directed to inductive detection systems, the general principles of the invention may be extendable to other detection techniques such as capacitive systems.

It will be apparent to a skilled person that changes and modifications to the described systems may be made without departing from the spirit and scope of the invention as set forth herein and shown in the accompanying drawings and as defined in the following claims.

I claim:

1. System for detecting the presence of a cooking vessel positioned over a heating element of a cooking hob comprising:

a first drive loop for generating a time varying magnetic field upon the application of an alternating current thereto;

a first sensor loop proximal to said drive loop wherein, in the absence of a cooking vessel, said time varying magnetic field generates a sensor signal in said sensor loop, and wherein said sensor signal is reduced in magnitude when a metallic cooking vessel is placed vicinal to said drive loop;

a current supply for supplying said alternating current to said drive loop; and a controller connected to said current supply and said sensor loop for monitoring said sensor signal to determine the presence of said cooking vessel and for controlling said heating element in response thereto, wherein said drive loop and said sensor loop are electronically connected to each other.

2. System for detecting the presence of a cooking vessel positioned over a heating element of a cooking hob comprising:

a first drive loop for generating a time varying magnetic field upon the application of an alternating current thereto;

a first sensor loop proximal to said drive loop wherein, in the absence of a cooking vessel, said time varying magnetic field generates a sensor signal in said sensor loop, and wherein said sensor signal is reduced in magnitude when a metallic cooking vessel is placed vicinal to said drive loop;

a current supply for supplying said alternating current to said drive loop; and a controller connected to said current supply and said sensor loop for monitoring said sensor signal to determine the presence of said cooking vessel and for controlling said heating element in response thereto, wherein said drive loop and said sensor loop are electronically connected to each other, wherein said alternating current is passed to said drive loop by connection leads connected to said drive loop and wherein one of said connection leads is a common lead which is also connected to said sensor loop.

3. The system of claim 2 wherein said common lead has a cross-sectional width which is greater than a cross-sectional width of said other connection lead.

4. The system of claim 1 further comprising a second drive loop and a second sensor loop positioned around said first drive and sensor loops and wherein said first and second drive and sensor loops are electronically connected to each other.

5. System for detecting the presence of a cooking vessel positioned over a heating element of a cooking hob comprising:

a first drive loop for generating a first time varying magnetic field upon the application of an alternating current thereto;

a second drive loop for generating a second time varying magnetic field upon the application of an alternating current thereto;

a first sensor loop proximal to said first drive loop wherein, in the absence of a cooking vessel, said first time varying magnetic field in said first drive loop generates a first sensor signal in said first sensor loop, and wherein said sensor signal is reduced in magnitude when a metallic cooking vessel is placed vicinal to said first drive loop;

a second sensor loop positioned around said first drive and sensor loops wherein, in the absence of a cooking vessel, said second time varying magnetic field in said second drive loop generates a second sensor signal in said second sensor loop, and wherein said sensor signal is reduced in magnitude when a metallic cooking vessel is placed vicinal to said second drive loop;

a current supply for supplying said alternating current to said first and second drive loops; and a controller connected to said current supply and said first and second sensor loops for monitoring said sensor signal to determine the presence of said cooking vessel and for controlling said heating element in response thereto, wherein said drive loop and said sensor loop are electronically connected to each other, wherein input leads are connected to ends of said first and second drive loop and wherein input leads connected to said second drive loop are arranged on each side of leads connected to said first drive loop.

6. The system of claim 1 comprising a plurality of drive loops and sensor loops for detecting the presence of a cooking vessel placed over one of a plurality of heating elements.

7. The system of claim 6 wherein said plurality of drive loops and said plurality of sensor loops are electronically connected together.

8. The system of claim 6 wherein sensor signals generated by said plurality of sensor loops are multiplexed to said controller.

9. The system of claim 1 wherein at least one of said drive and sensor loops has connections thereto for monitoring an electrical resistance of said at least one of said drive and sensor loops.

10. System for detecting the presence of at least one cooking vessel positioned over at least one of a plurality of heating elements of a cooking hob comprising:

a plurality of detection elements each detection element comprising:

a drive loop for generating a time varying magnetic filed upon the application of an alternating current thereto;

a sensor loop proximal to said drive loop wherein in the absence of a cooking vessel said time varying magnetic field generates a sensor signal in said sensor loop and said sensor signal is reduced in magnitude when a metallic cooking vessel is place vicinal to said drive loop;

wherein said system further comprises a current supply for supplying an alternating current to at least a dive loop of a selected detection element; and a controller connected to said current supply including a multiplexer or monitoring a sensor signal of a selected detection element to determine the presence of a cooking vessel and for controlling a heating element corresponding to said selected detection element in response thereto, and wherein drive loops and sensor loops of said detection elements are electronically connected to each other.

* * * * *